United States Patent [19]

Kosuge et al.

[11] 4,318,754

[45] Mar. 9, 1982

[54] SURFACE TREATMENT METHOD FOR TIN-FREE STEEL

[75] Inventors: Norio Kosuge, Yokohama; Shunichi Tsugawa; Hajima Kimura, both of Chiba, all of Japan

[73] Assignee: Kawasaki Steel Corporation, Hyogo, Japan

[21] Appl. No.: 79,207

[22] Filed: Sep. 26, 1979

[30] Foreign Application Priority Data

Oct. 3, 1978 [JP] Japan ..... 53-121655

[51] Int. Cl.[3] ..... C23F 7/12

[52] U.S. Cl. ..... 148/6.2; 148/6.14 A; 148/6.16; 148/6.21; 156/327; 220/62; 220/83; 220/455; 220/456; 220/457; 427/388.4

[58] Field of Search ..... 427/388.4, 409, 327, 427/387; 428/461, 457, 469, 470, 684, 664, 35, 447, 412; 156/327, 308.4; 220/455, 456, 457, 62, 83; 106/14.12, 14.13; 148/6.2, 12 C, 6.15 R, 6.16, 12 D, 6.21, 6.14 A, 31.5; 204/41, 37 R, 38 E, 141.5; 72/46, 47, 54

[56] References Cited

U.S. PATENT DOCUMENTS

| | | | |
|---|---|---|---|
| 3,466,207 | 9/1969 | Vincent et al. | 148/6.16 X |
| 3,519,542 | 7/1970 | Kitamura et al. | 204/35 |
| 3,679,513 | 7/1972 | Addinall et al. | 428/461 X |
| 3,799,814 | 3/1974 | Yamagishi et al. | 148/6.2 |
| 3,900,689 | 8/1975 | Deyrup | 428/461 X |
| 3,907,608 | 9/1975 | Barrett et al. | 148/6.2 |
| 3,991,230 | 11/1976 | Dickie et al. | 427/44 |
| 3,997,694 | 12/1976 | Wu | 428/35 |
| 4,160,056 | 7/1979 | Tanaka et al. | 428/461 X |
| 4,164,587 | 8/1979 | Borman | 428/35 X |

*Primary Examiner*—Norman Morgenstern
*Assistant Examiner*—Thurman K. Page
*Attorney, Agent, or Firm*—Koda and Androlia

[57] ABSTRACT

A surface treatment method for tin-free steel, which comprises applying a water solution, containing a polymer obtained from one or two or more kinds of monomers of unsaturated carboxylic acids, on to the surface of a steel sheet having a metallic chromium layer formed thereon and having a film, mainly consisting of hydrated chromic oxide, formed on the above layer, and then conducting heating and drying. The coating of tin-free steel obtained by this method is excellent in adhesiveness and is most suitable for bonded cans requiring high-temperature treatment.

2 Claims, 1 Drawing Figure

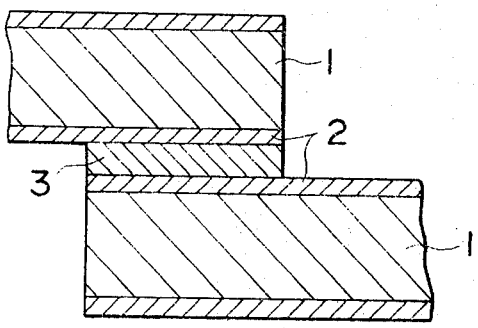
1
2
3
1

SURFACE TREATMENT METHOD FOR TIN-FREE STEEL

BACKGROUND OF THE INVENTION

1. Field of the Invention

This invention relates to a surface treatment method for tin-free steel. More particularly, the invention relates to a surface treatment method to improve the adhesiveness of a coating formed by coating with paint and baking on the surface of a steel sheet having a hydrated chromic oxide on a chromium plate layer.

2. Description of the Prior Art

As the tin-free steel recently developed as a material for food cans is excellent in adhesion to organic polymer materials such as paints and adhesive, the so-called three-piece bonded cans whose shells are bonded using the above can material are manufactured and put of the market. In case the content of the bonded can is a carbonated beverage, beer or the like, high temperature is not applied to the bonded portion of the can before and after the content is packed in the can. Therefore, it is seldom that the bonding strength decreases and that damage is caused to the can shell. Further, the bonding strength scarcely decreases when the can after the packing is stored at room temperature for a long time.

Lately, however, there is a tendency to use the bonded cans for other contents which may need high-temperature packing and high-temperature sterilization after the packing. In this case, if the bonded portion of the bonded can is exposed to the content containing water of high temperature, water molecules filtration through the coating layer severely promote deterioration of the bonded portion, which causes the bonded portion of the can shell to be fractured in a short time during or after the packing, thereby giving rise to leakage or broken shell.

A cross-section of the bonded portion of a typical bonded can is shown in FIG. 1, in which the reference numberal 1 designates tin-free steel, 2 designates a coating layer and 3 designates a adhesive. Through the strength of such bonded portion depends on the tensile strength of coating layer 2 and adhesive 3, the locations of fracture which are the most important porblem are between tin-free steel 1 and coating layer 2, between coating layer 2 and adhesive 3 and between the chromium plate layer and the hydrated chromic oxide in tin-free steel 1.

The bond between coating layer 2 and the surface of tin-free steel 1 is thought to be due to the hydrogen bond formed between the OH group in the hydrated chromic oxide and the —OH group of an epoxy-phenol paint most generally used for coatings. This hydrogen bond is higher in binding strength than the physical adsorption most generally caused between coatings and metallic surfaces. However, if the bonded portion is brought into contact with a water solution containing polar substances such as urea and the like, the bond is caused to be broken. In particular, the higher the temperature of such water solution, the more the quantity filtration through the coating and bonding agent increases and the more the speed of breaking the bond increases. Therefore, the bonded portion disadvantageously is caused to be fractured between coating 2 and tin-free steel 1. Moreover, even at lower ambient temperatures, the bonding strength inevitably decreases below the initial value with the lapse of time.

It is an object of this invention to provide a surface treatment method for tin-free steel being suitable for bonded cans, which permits to prevent the fracture to be caused in a short time to the bonded portion of the bonded can after subjected to high-temperature treatment such as high-temperature packing and high-temperature sterilization after the content having been packed in the can.

It is another object of the invention to provide a surface treatment method for tin-free steel being suitable for bonded cans, which permits the bonded can to maintain the initial bonding strength during long-term storage after the content having been packed in the can and the can subjected to high-temperature treatment.

SUMMARY OF THE INVENTION

The inventors of this invention has carried out studies with a view to forming between tin-free steel and coating layer many coordinate bonds and covalent bonds having a higher binding energy than the ordinary hydrogen bond. As a result, it has been found that the above object can be accomplished by applying a water solution, containing a polymer obtained from one or two or more kinds of monomers of unsaturated carboxylic acids, on to an active surface having a metallic chromium layer formed thereon and having a film, mainly consisting of hydrated chromic oxide, formed on the above layer, and then conducting heating and drying. This invention has been attained on the basis of the above finding.

BRIEF DESCRIPTION OF THE DRAWING

The FIGURE is a cross-sectional view of the bonded portion of a bonded can of tin-free steel treated by the method of the invention.

DETAILED DESCRIPTION OF THE INVENTION

The polymers employed in this invention are those obtained from one or two or more kinds of monomers of unsaturated carboxylic acids comprising an unsaturated bond and carboxyl group (—COOH) in a molecule. The unsaturated carboxylic acids can be exemplified by unsaturated monocarboxylic acids, unsaturated dicarboxylic acids and unsaturated tricarboxylic acids. The polymers obtained from unsaturated monocarboxylic acids are those having the carboxyl groups at side chains or producing them in water solutions. It is desirable to use such polymers as water-soluble polyacrylic acid and polymethacrylic acid which can be solely dissolved in water. However, even copolymers with acryl esters and methacryl esters can also be employed if they are dissolved in water.

The unsaturated dicarboxylic acids include maleic acid, itaconic acid, 2-butene-1.4-dicarboxylic acid, methyl maleic acid, muconic acid, etc. The unsatureated tricarboxylic acids can be exemplified by aconitic acid, in particular. The polymers employed in the invention may be either homopolymers obtained only from monomers selected from the above-mentioned unsaturated dicarboxylic acids or unsaturated tricarboxylic acids, or copolymers obtained only from two or more kinds of monomers selected from unsaturated dicarboxylic acids or unsaturated tricarboxylic acids. Some of these polymers are solely dissolved in water, but some are not so. In the latter case, they can be made soluble in water by adding suitable alkaline substances thereto. As the alkaline substances, it is preferable to use relatively volatile substances such as ammonium, organic amine and the like. It should be noted that such substances as alkali metal salts are unsuitable which remain on the surface of tin-free steel and promote worsening of the adhesiveness of the coating layer.

In this, invention, the above-mentioned polymers are employed as the first component, and further a water-soluble second component can be added thereto. Exemplified as the second component are one or two or more members selected from the group consisting of water-soluble carboxylic acids, organic phosphoric acid compounds, organic phosphorous acid compounds, organic sulfinic acid and its derivatives, organic sulfonic acid and its derivatives, or inorganic acids. Suitable as the water-soluble carboxylic acids are monocarboxylic acids, dicarboxylic acids, oxydicarboxylic acids and oxytricarboxylic acids. The monocarboxylic acids can be exemplified by formic acid, acetic acid, monochloroacetic acid, trichloroacetic acid, propionic acid, etc. Exemplified as the dicarboxylic acids are unsaturated dicarboxylic acids such as oxalic acid, molonic acid, succinic acid, glutaric acid, adipic acid, pimelic acid, etc. Exemplified as the oxydicarboxylic acids are malic acid and tartaric acid. Exemplified as the oxytricarboxylic acid is citric acid. Exemplified as the organic phosphoric acid compounds are dimethyl phosphate, etc. The organic phosphorous acid compounds can be exemplified by dimethyl-phosponic acid, in particular. The derivatives of sulfonic acid can be exemplified by methane sulfonic acid, ethane sulfonic acid, benzene sulfonic acid, toluene sulfonic acid, etc. The derivatives of sulfonic acid can be exemplified by 1-butane sulfinic acid, benzene sulfinic acid, toluene sulfinic acid, etc. The water-soluble inorganic acids can be exemplified by hydrochloric acid, sulfuric acid, phosphoric acid, nitric acid, boric acid, etc.

The addition ratio of the above second component, the acids, to the above first component, the polymer, is preferably in the range of less than 20 parts by weight to 100 parts by weight. If the addition ratio of the second component, the acids, exceeds the above range, the full effects aimed at by the invention cannot be obtained. Further, if the addition ratio is below the lower limit, the bonding strength just after the bonding tends to decrease.

The concentration of the treating solution containing the above components is suitable when it is such that the concentration of the first component, the polymer, is in the range from 0.03 g/l to 3.0 g/l. If the concentration of the treating solution exceeds 3.0 g/l, stripes of stain appear on the treated surface of steel sheet, thereby worsening the surface appearance. If the concentration is below 0.03 g/l, the full effects aimed at by the invention cannot be obtained.

In this invention, though the functioning mechanism of each component in the above treating solution is not fully clarified, it appears that the —COOH group in the polymer molecules is strongly adsorbed on the active layer of hydrated chromic oxide on the surface of tin-free steel, and a metallic complex is formed between chromium atom and carboxylic acid group by heat treatment (including drying of the treating solution on the surface and heating at the time of baking the paint), thereby forming the coordinate bond that is stronger than the hydrogen bond. Also, it is presumed that part of the carboxyl group in the polymer molecules is oriented to the coating layer side due to the flexibility of the molecular chain and enters a condensation reaction with the —$CH_2OH$ group in the coating layer, thereby forming the strong covalent bond. Further, in case the polymer employed in this invention is obtained by polymerization of monomers consisting of unsaturated carboxylic acids having two or more carboxyl groups in a molecule, the carboxyl group concentration in the polymer molecules is high and, hence, the portions of the above-mentioned coordinate bond and covalent bond can be increased, which permits to enhance the effects aimed at by the invention.

On the other hand, it is thought that the second component (acids) to be added in a small quantity to the treating solution of the invention acts as a catalyst to cause the coordinate bond and covalent bond to be formed between coating and tin-free steel, and also serves to form a stable bond in like manner as the first component because the second component itself is strongly adsorbed between coating layer and tin-free steel. Therefore, in case of using a polymer of acrylic acid or methacrylic acid or a polymer, such as a copolymer of the monomer of the above acid and other monomer, which is obtained from monomers having one carboxyl group, it is desirable to make the polymer coexist with the second component (acids).

The surface treatment of this invention is performed by forming on a metallic chromium plate layer a film mainly consisting of hydrated chromic oxide, applying the above-mentioned treating solution by spraying, immersion, etc., and conducting the above-mentioned heating and drying. The bonded cans which are fabricated using the tin-free steel produced by the treatment method of this invention, coated with paint and baked, and further bonded by using a heated and melted adhesive and applying pressure are stronger than the conventional ones in the bond between paint and tin-free steel, so that the bond is not broken by water, etc. contained in the content and keeps a stable strength in a high-temperature condition before and after the packing, and further the bonding strength does not decrease during long-term storage.

DETAILED DESCRIPTION OF THE PREFERRED EMBODIMENTS

EXAMPLES 1 to 15

The original sheet for tin-free steel (0.17 mm steel sheet) was degreased and pickled, and was then subjected to electrolysis for one sedcond with a current density of 50 A/dm$^2$ in a chromium plating solution comprising 2.5 moles/l of $CrO_3$ and 0.025 mole/l of $H_2SO_4$. After the end of electrolysis, the sheet was immersed as it was in the chromium plating solution for two seconds and was then sufficiently washed with water. Next, electrolytic treatment was conducted for one second witha current density of 10 A/dm$^2$ in an electrolytic chromic acid treating solution comprising 0.8 mole/l of $CrO_3$, thereby the tin-free steel was obtained. The tin-free steel thus obtained was washed with water. Immediately after that, the tin-free steel was immersed for about 10 secondsin a treating solution having the composition given in Table 1 below, and was then withdrawn therefrom followed by drying with hot air of about 100° C. Thus treated tin-free steel was used as a test sheet.

This test sheet was heated for 10 minutes at 195° C., and was then coated with an epoxy phenol paint for cans at a rate of 50±5 mg/dm$^2$ and baked for 10 minutes at 210° C. Next, thus coated sheet was cut into pieces of 5 mm in width and 100 mm in length. These pieces were placed face to face each with the coated surface inward. An adhesive tape of Nylon 12 (100μ thick×5 mm wide) was interposed between the pieces, and the pieces were bonded for 30 seconds at 200° C. applying a pressure of 1 kg/cm$^2$ and then cooled at room temperature. The bonding test pieces were immediately tested for peeling off at a pulling speed of 200 mm/min by use of an Instron tensile testing machine, thereby the peel-off strength was measured.

Apart from the above test, in order to reproduce the changes in bonding strength of the bonded can at the time of high-temperature packing, the test pieces (5 mm wide) after the bonding were immersed for 5 days in a saccharic acid solution of 80° C. (15 g/l of sucrose, adjusted to pH=3.3 with citric acid), and was then dried and measured at room temperature for the T type peel-off strength. Further, as Comparative Example, the steel sheet was plated with chromium in the same conditions as described in the above, subjected to electrolytic chromic acid treatment, washed with water, dried without being subjected to the treatment of the invention, coated with paint and baked. Thus treated steel sheet was bonded and cut into 5 mm wide pieces, and these pieces were additionally included in the above tests. The results of these tests are given in Tables 1 to 3.

From the results given in Tables 1 to 3, it can be seen that the bonding strength of the test pieces according to this invention is not different from those of Comparative Example 1 just after the bonding, but there appears a definite difference after the high-temperature immersion in the saccharic acid solution, i.e., the bonding strength according to the treatment method of the invention is higher.

EXAMPLES 16 to 18

The test method for the T type peel strength just after the bonding is the same as in Examples 1 to 15. However, apart from this, in order to reproduce the changes in bonding strength of the bonded can at the time of high-temperature packing, the test pieces (5 mm wide) after the bonding were immersed for 30 minutes in a saccharic acid solution of 80° C. (15 g/l of sucrose, adjusted to pH=3.3 with citric acid) and were measured in that state for the T type peel-off strength. Further, to estimate the stability of the bonded can during long-term storage from the changes in bonding strength, accelerated deterioration test was conducted. Furthermore, the bonding test pieces (5 mm wide) were immersed for 7 days in the above succharic acid solution of 70° C. and were then dried and measured at room temperature for the T type peel strength.

TABLE 1

| Test piece | Composition & concentration of treating solution | | T type peel-off strength just after bonding (kg/5 mm) | T type peel-off strength at room temp. after 5-day immersion in a saccharic acid solution (80° C.) (kg/5 mm) |
|---|---|---|---|---|
| | Polyacrylic acid | 0.5 g | | |
| Example 1 | Acetic acid | 0.1 g | 4.5 | 4.4 |
| | Pure water | 1 l | | |
| | Polyacrylic acid | 0.5 g | | |
| Example 2 | Sulfuric acid | 0.05 g | 4.2 | 3.5 |
| | Pure water | 1 l | | |
| | Polymethacrylic acid | 0.5 g | | |
| Example 3 | Phosphoric acid | 0.1 g | 4.3 | 3.8 |
| | Pure water | 1 l | | |
| | Polymethacrylic acid | 0.5 g | | |
| Example 4 | P-toluene-sulfonic acid | 0.1 g | 4.5 | 3.8 |
| | Pure water | 1 l | | |
| | Polyacrylic acid | 0.5 g | | |
| Example 5 | Dimethyl-phosphonic acid | 0.1 g | 4.2 | 3.7 |
| | Pure water | 1 l | | |
| | Polyacrylic acid | 0.5 g | | |
| Example 6 | Dimethyl-phosphate | 0.1 g | 4.5 | 3.8 |
| | Pure water | 1 l | | |
| | Polyacrylic acid | 0.5 g | | |
| Example 7 | P-toluene-sulfinic acid | 0.1 g | 4.2 | 3.6 |
| | Pure water | 1 l | | |
| Comparative Example 1 | No treatment | | 4.3 | 0.5 |

TABLE 2

| Test piece | Composition & concentration of treating solution | | T type peel-off strength just after bonding (kg/5 mm) | T type peel-off strength at room temp. after 5-day immersion in a saccharic acid solution (80° C.) (kg/5 mm) |
|---|---|---|---|---|
| | Itaconic acid-aconitic acid | | | |
| Example 8 | copolymer | 0.5 g | 4.5 | 3.9 |
| | Pure water | 1 l | | |
| | Poly(trans-2-butene-1.4- | | | |
| Example 9 | dicarboxylic acid) | 0.5 g | 4.3 | 3.5 |
| | Pure water | 1 l | | |
| | Polyitaconic acid | 0.5 g | | |
| Example 10 | Tartaric acid | 0.1 g | 4.3 | 4.2 |
| | Pure water | 1 l | | |

TABLE 2-continued

| Test piece | Composition & concentration of treating solution | | T type peel-off strength just after bonding (kg/5 mm) | T type peel-off strength at room temp. after 5-day immersion in a saccharic acid solution (80° C.) (kg/5 mm) |
|---|---|---|---|---|
| | Polyitaconic acid | 0.5 g | | |
| Example 11 | Sulfuric acid | 0.05 g | 4.2 | 4.2 |
| | Pure water | 1 l | | |

TABLE 3

| Test piece | Composition & concentration of treating solution | | T type peel-off strength just after bonding (kg/5 mm) | T type peel-off strength at room temp. after 5-day immersion in a saccharic acid solution (80° C.) (kg/5 mm) |
|---|---|---|---|---|
| | Itaconic acid-aconitic acid copolymer | 0.5 g | | |
| Example 12 | Dimethyl-phosphonic acid | 0.05 g | 4.4 | 4.2 |
| | Pure water | 1 l | | |
| | Itaconic acid-aconitic acid copolymer | 0.5 g | | |
| Example 13 | Dimethyl-phosphate | 0.1 g | 4.5 | 4.3 |
| | Pure water | 1 l | | |
| | Poly(trans-2-butene-1.4-dicarboxylic acid) | 0.5 g | | |
| Example 14 | P-toluene-sulfonic acid | 0.1 g | 4.5 | 4.0 |
| | Pure water | 1 l | | |
| | Poly(trans-2-butene-1.4-dicarboxylic acid) | 0.5 g | | |
| Example 15 | P-toluene-sulfinic acid | 0.1 g | 4.6 | 4.1 |
| | Pure water | 1 l | | |

Besides, as comparative Example, the steel sheet was plated with chromium in the same conditions as described in the above, heated with chromate, washed with water, dried without being subjected to the treatment of the invention, coated with paint and heated. Thus treated sheet was bonded and cut into 5 mm wide pieces, and these pieces were additionally included in the above tests. The test results are given in Table 4.

As is apparent from the results of Table 4, the bonding strength of the test pieces according to this invention is not different from those of Comparative Example 2 just after the bonding, but there appears a definite difference in the case of high-temperature immersion and after the 7-day immersion, i.e., the bonding strength according to the treatment method of the invention is higher. In particular, the strength after the 7-day immersion is at nearly the same level as the initial strength just after the bonding, which means that the secular change in bonding strength does not occur at all. The strength in the case of immersion at 80° C. is lower than that at room temperature, which, however, is thought to be due to the softening by heat of the paint and bonding agent. In this case, however, the strength in any one of Examples of the invention is about two times higher than that of Comparative Example. Therefore, it is apparent that the bonding strength does not lower but slightly even at high temperatures and the reliability of the bonded portion is very high.

Thus, the bonded cans fabricated by using the tin-free steel treated by the method of this invention do not have their bonded portions deteriorated by any such high-temperature treatment as high-temperature packing or high-temperature sterilization after the content having been packed, are protected against fracture to be caused in a short time, and can fully maintain the initial bonding strength during long-term storage.

TABLE 4

| Test piece | Composition & concentration of treating solution | | T type peel-off strength just after bonding (kg/5 mm) | T-type peel-off strength at 80° C. in a saccharic acid solution (kg/5 mm) | T type peel-off strength at room temp. after 7-day immersion in a saccharic acid solution (70° C.) (kg/5 mm) |
|---|---|---|---|---|---|
| | Polyacrylic acid | 1 g | | | |
| Example 16 | Malonic acid | 0.1 g | 4.0 | 2.8 | 4.3 |
| | Pure water | 1 l | | | |
| | Polymethacrylic acid | 1 g | | | |
| Example 17 | Citric acid | 0.1 g | 4.0 | 2.6 | 4.1 |
| | Pure water | 1 l | | | |
| | Ammonium salt of acrylic acid-ethylacrylate copolymer | 3 g | | | |
| Example 18 | Maleic acid | 0.1 g | 3.9 | 2.5 | 3.6 |
| | Pure water | 1 l | | | |
| Comparative | No treatment | | 3.9 | 1.4* | 1.1* |

TABLE 4-continued

| Test piece | Composition & concentration of treating solution | T type peel-off strength just after bonding (kg/5 mm) | T-type peel-off strength at 80° C. in a saccharic acid solution (kg/5 mm) | T type peel-off strength at room temp. after 7-day immersion in a saccharic acid solution (70° C.) (kg/5 mm) |
|---|---|---|---|---|
| Example 2 | | | | |

*In every case, peeling off took place between coating and tin-free steel.

What is claimed is:

1. A surface treatment method for a tin-free steel surface having a hydrated chromic oxide layer, which comprises applying a water solution, containing as a first component a polymer obtained from one or two or more kinds of monomers of unsaturated carboxylic acids only and one or two or more members selected from the group consisting of water soluble carboxylic acids, organic phosphoric acid compounds, organic phosphorus acid compounds, sulfinic acid and its derivatives, sulfonic acid and its derivatives, or inorganic salts as a second component mixed with said first component, onto the surface of tin-free steel sheets conducting heating and drying.

2. A method according to claim 1, in which said polymer is a polymer of acrylic acid or methacrylic acid, or a copolymer of the monomer of said acid and another monomer selected from the group consisting of unsaturated carboxylic acids.

* * * * *

UNITED STATES PATENT AND TRADEMARK OFFICE

CERTIFICATE OF CORRECTION

PATENT NO. : 4,318,754

DATED : March 9, 1982

INVENTOR(S) : Norio Kosuge, et al

It is certified that error appears in the above—identified patent and that said Letters Patent is hereby corrected as shown below:

At [75] Inventors:, change "Hajima Kimura" to

--Hajime Kimura--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*